US008020844B2

(12) United States Patent
Takenouchi et al.

(10) Patent No.: US 8,020,844 B2
(45) Date of Patent: Sep. 20, 2011

(54) PRINTER AND CONTROL METHOD FOR PRINTER

(75) Inventors: Yoshikuni Takenouchi, Amimachi (JP); Takashi Matsutani, Amimachi (JP); Ayako Kawano, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 216 days.

(21) Appl. No.: 12/588,252

(22) Filed: Oct. 8, 2009

(65) Prior Publication Data

US 2010/0090387 A1 Apr. 15, 2010

(30) Foreign Application Priority Data

Oct. 10, 2008 (JP) ..... P2008-263969

(51) Int. Cl.
*G03G 15/00* (2006.01)

(52) U.S. Cl. ..... 270/1.01; 399/15; 399/404; 414/791.2

(58) Field of Classification Search ..... 270/1.01, 270/58.01; 414/791.2; 399/15, 404, 9, 23
See application file for complete search history.

(56) References Cited

U.S. PATENT DOCUMENTS 3,936,180 A * 2/1976 Willard et al. ..... 399/10
4,448,515 A * 5/1984 Ishikawa ..... 399/15
4,657,375 A * 4/1987 Watanabe et al. ..... 399/15
5,504,696 A * 4/1996 Debes ..... 702/95
6,115,510 A * 9/2000 Koga ..... 382/309
6,122,457 A * 9/2000 Kizaki ..... 399/11
6,209,865 B1 * 4/2001 Regimbal et al. ..... 271/220
6,533,265 B1 * 3/2003 Baldini ..... 271/207
6,757,500 B2 * 6/2004 Kuboki ..... 399/15

FOREIGN PATENT DOCUMENTS

JP 2001-039546 2/2001

* cited by examiner

*Primary Examiner* — Patrick Mackey
(74) *Attorney, Agent, or Firm* — The Nath Law Group; Jerald L. Meyer; Derek Richmond

(57) ABSTRACT

A setting acceptor is operable to accept printing settings for a current printing job, including a setting of a first printing condition involving a confirmation print to print a copy set of sorted pages before a temporary pause waiting for a continuation instruction to print a designated number of copy sets, and a setting of a second printing condition involving a sorting print to print the designated number of copy sets of sorted pages, and a controller stores a last stack position in a previous printing job, as a first stack position, and is operable, as the printing settings accepted includes the setting of the first printing condition and the setting of the second printing condition, to discharge sheets in the confirmation print to a second stack position offset from the first stack position, and after the continuation instruction, discharge sheets of the designated number of copy sets in the sorting print to an alternating stack position alternating every copy set between the first and second stack positions, starting from the second stack position.

6 Claims, 9 Drawing Sheets

PRINTER AND CONTROL METHOD FOR PRINTER

BACKGROUND OF THE INVENTION

1. Field of the Invention

The present invention relates to a printer, and a control method for the printer.

2. Description of Related Art

Japanese Patent Application Laid-Open Publication No. 2001-39546 discloses a prevailing control technique for printers including: providing an offset-stacking sheet discharge mechanism for discharging printed sheets to a stack position alternating between offset positions, and printing a plurality of copy sets; and controlling the stack position to alternate every copy set to thereby define sections of copy set stacks. For a current printing job following a previous printing job, it stores in memory a last stack position in the previous printing job, and determines a position offset from that position as an initial stack position in the current printing job. This permits sections of stack sets to be defined between the previous and current printing jobs, without confusion, when the current printing job is started without removing a set of copy-set stacks of the previous printing job from a stacker.

FIG. 1 illustrates a result of an offset stacking on a stacker. It shows a result of a printing job series including a sorting print job 1 for printing two copy sets each consisting of three pages, and a sorting print job 2 for printing two copy sets each consisting of four pages. As used herein, for a printer, the sorting print means a consecutive printing of a designated number of copy sets each consisting of a given number of pages sorted in order. In a non-sorting print, the printer makes a consecutive printing of copy sets corresponding in number to the given page number, the copy sets each consisting of non-sorted sheets (of a page) corresponding in number to the designated copy set number. Accordingly, the non-sorting print provides a total number of printed sheets identical to that of the sorting print.

As illustrated in the above figure, the job 1 provides a set of copy-set stacks including a first copy set consisting of pages sorted in order of a $1^{st}$, a $2^{nd}$, and a $3^{rd}$ and stacked in a position at the left in the figure, and a second copy set consisting of pages sorted in order of a $1^{st}$, a $2^{nd}$, and a $3^{rd}$ and stacked in a position at the right in the figure. This allows for defined stack sections of the first and second copy sets.

Then, the job 2 provides a first copy set consisting of pages sorted in order of a $1^{st}$, a $2^{nd}$, a $3^{rd}$, and a $4^{th}$ and stacked in a position at the left in the figure. This is because the printer, which has stored in memory a last stack position of job 1 as the right, determines a position offset to the left from that position as an initial stack position in job 2. The job 2 further provides a second copy set consisting of pages sorted in order of a $1^{st}$, a $2^{nd}$, a $3^{rd}$, and a $4^{th}$ and stacked in a position offset to the right in the figure. This allows for defined stack sections of the first and second copy sets, as well as for defined sections of stack sets of job 1 and job 2.

SUMMARY OF THE INVENTION

There are printers developed with a function of confirmation print for printing a single copy set consisting of a given number of pages sorted in order, before a temporary pause by an interruption to the printing, where it waits for a continuation instruction of user to print a total number of sheets corresponding to a designated number of copy sets.

FIG. 2A illustrates a result of application of the function of confirmation print to an offset stacking on a stacker. More specifically, this figure shows a result of a series of printing jobs including a sorting print job 1 for printing two copy sets each consisting of three pages, and a sorting print job 2 for printing two copy sets each consisting of four pages subject to a setting of confirmation print.

As illustrated in the figure above, the job 1 outputs a page-sorted first copy set stacked in a position at the left in the figure, and a page-sorted second copy set stacked in a position at the right in the figure. This provides defined sections of the first and second copy sets.

Next, the job 2 outputs, first for confirmation, a page-sorted copy set stacked in a position offset to the left from the last stack position of job 1. Then, the job 2 enters a temporary pause, where it receives a continuation instruction from user, responding thereto by outputting a combination of a page-sorted first copy set stacked in a position offset to the right from the stack position of copy set for confirmation, and a page-sorted second copy set stacked in a position again offset to the left. As a result, the copy set for confirmation and the first and second copy sets appear defined as stack sections. In addition, the jobs 1 and 2 also look defined as sections of stack sets.

However, the copy set for confirmation is output in accordance with a setting by a user with an intention to check the print. Therefore, given a print for confirmation, the user will take the print out of the stacker, to check the contents before operation to provide a continuation instruction. As a result, as illustrated in FIG. 2B, the job 2 has a first stack position superposed on the last stack position of job 1, with undefined sections of stack sets of job 1 and job 2, as an issue.

In view of the foregoing, it is an object of the present invention to provide a printer including an offset-stacking sheet discharge mechanism adapted to discharge sheets to a plurality of stack positions, and a control method of the same, allowing for defined stack sections of copy sets, as well as for defined sections of stack sets of printing jobs, even after a setting of confirmation print.

To achieve the object described, according to a first aspect of the present invention, a printer comprises an offset-stacking sheet discharge mechanism adapted to discharge sheets to a plurality of stack positions, a setting acceptor configured to accept a set of printing settings for a current printing job to print a total number of sheets corresponding to a designated number of copy sets, including a setting of a first printing condition involving a confirmation print to print a single copy set consisting of a given number of sorted pages before a temporary pause waiting for a continuation instruction to print the total number of sheets, and a setting of a second printing condition involving a sorting print to print the designated number of copy sets each consisting of the given number of sorted pages to thereby print the total number of sheets, and a controller configured to store therein a last stack position in a previous printing job, as a first stack position, and adapted, as the set of printing settings accepted by the setting acceptor has a first subset thereof including the setting of the first printing condition and the setting of the second printing condition, to discharge sheets in the confirmation print in the first subset of the set of printing settings to a second stack position offset from the first stack position, and after acceptance of the continuation instruction for the first subset of the set of printing settings, discharge sheets of the designated number of copy sets in the sorting print in the first subset of the set of printing settings to an alternating stack position alternating every copy set between the first and second stack positions, starting from the second stack position.

To achieve the object described, according to a second aspect of the present invention, a printer comprises an offset-stacking sheet discharge mechanism adapted to discharge sheets to a plurality of stack positions, a setting acceptor configured to accept a set of printing settings including a setting of a first printing condition involving a trial print to check a printed state, and a setting of a second printing condition involving a sorting print to print a designated number of copy sets each consisting of a given number of sorted pages, and a controller configured to store therein a last stack position as a first stack position, and adapted, as the set of printing settings accepted by the setting acceptor has a first subset thereof including the setting of the first printing condition, to discharge sheets in the trial print in the first subset of the set of printing settings to a second stack position offset from the first stack position, and afterward as the set of printing settings accepted by the setting acceptor has a second subset thereof including the setting of the second printing condition, to discharge sheets of the designated number of copy sets in the sorting print in the second subset of the set of printing settings to an alternating stack position alternating every copy set between the first and second stack positions, starting from the second stack position.

To achieve the object described, according to a third aspect of the present invention, there is a control method provided for a printer including an offset-stacking sheet discharge mechanism adapted to discharge sheets to a plurality of stack positions, the control method comprising the steps of storing a last stack position in a previous printing job, as a first stack position, accepting a set of printing settings for a current printing job to print a total number of sheets corresponding to a designated number of copy sets, including a first printing condition involving a confirmation print to print a single copy set consisting of a given number of sorted pages before a temporary pause waiting for a continuation instruction to print the total number of sheets, and a second printing condition involving a sorting print to print the designated number of copy sets each consisting of the given number of sorted pages to thereby print the total number of sheets, discharging sheets in the confirmation print to a second stack position offset from the first stack position, and responding to acceptance of the continuation instruction, by discharging sheets of the designated number of copy sets to an alternating stack position alternating every copy set between the first and second stack positions, starting from the second stack position.

DETAILED DESCRIPTION OF EMBODIMENTS

Figure 1:
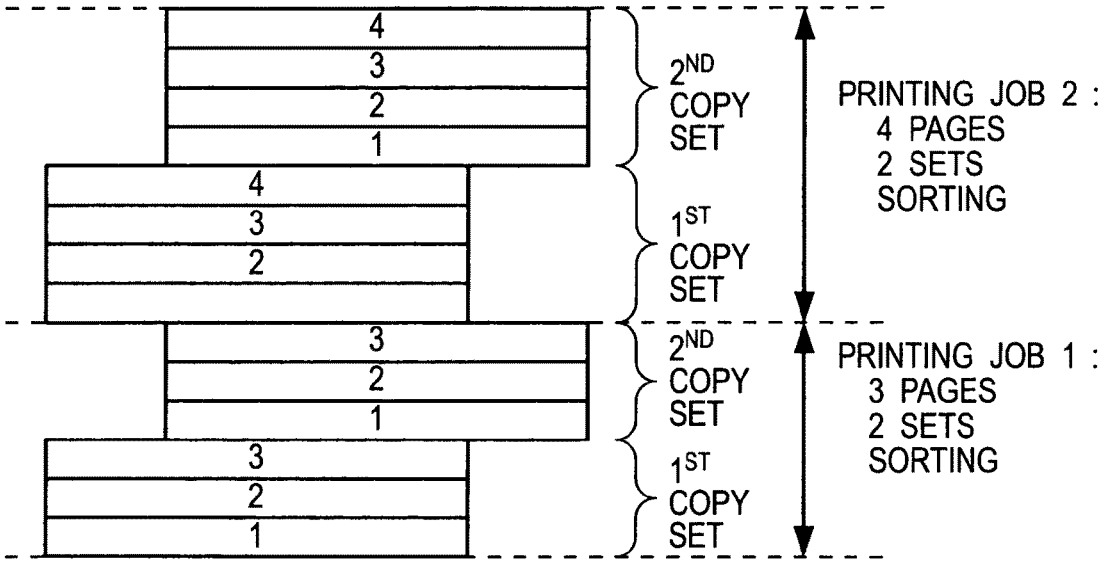
FIG. 1 is an illustration of a result of an offset stacking on a stacker.
Figure 2A:
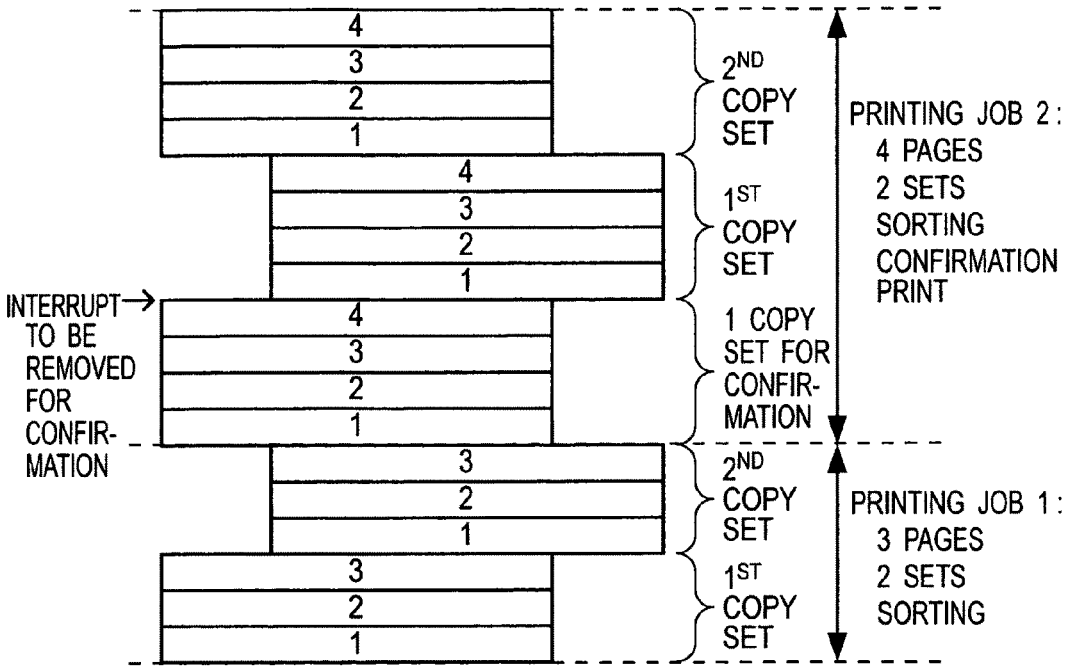
FIG. 2A is an illustration of a result of application of a function of confirmation print to an offset stacking on a stacker, and FIG. 2B, an illustration of a state on the stacker after removal of a copy set printed for confirmation.
Figure 2B:
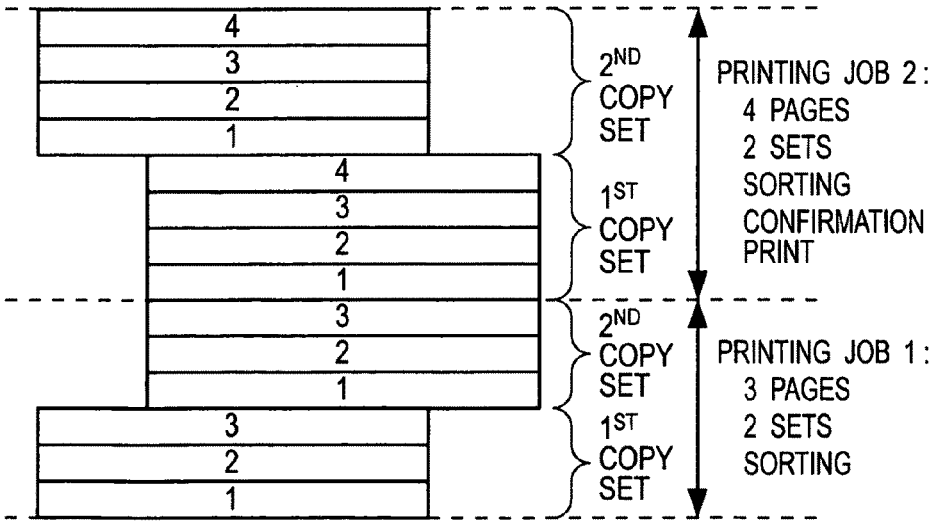
Figure 3:
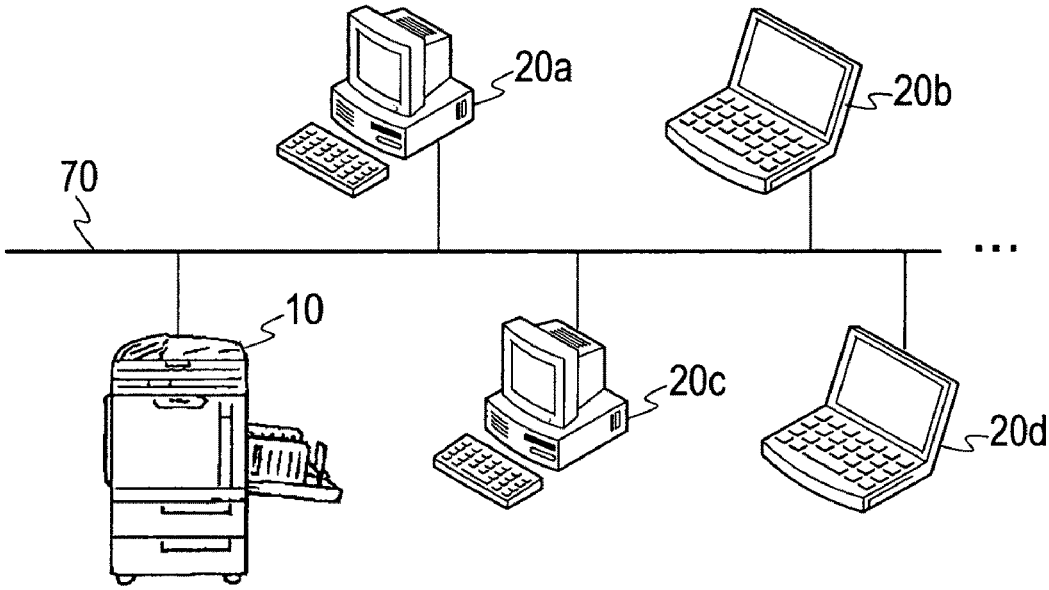
FIG. 3 is an illustration of configuration of a networked printing system as or including a printer according to an embodiment of the present invention.

There will be described an embodiment of the present invention, with reference to the accompanying drawings. FIG. 3 illustrates a hardware configuration of a networked printing system according to the present embodiment. As illustrated in the figure, the networked printing system is configured with a printing machine 10 and personal computers 20*a*, 20*b*, 20*c*, 20*d*, . . . (referred herein collectively to PC 20) each respectively connected to a computer network 70. Typically, the computer network 70 may be a local area network (LAN). It is noted that the present invention is not limited to a networked printing system, and may well be a stand-alone printing system including a printer 10 as a printing machine and local PC 20 directly connected thereto, or a single-machine system composed of a printer 10.

The printer 10 is a so-called complex machine configured with a printer function for a printing based on printing data sent from any PC 20, a scanner function for scanning an image of an original sheet on a platen to have a scanned image stored in memory or sent to any PC 20, and a copier function for printing the scanned image to duplicate. It may be connected to a phone line to have a facsimile function for transmission and reception of image data.

Figure 4:
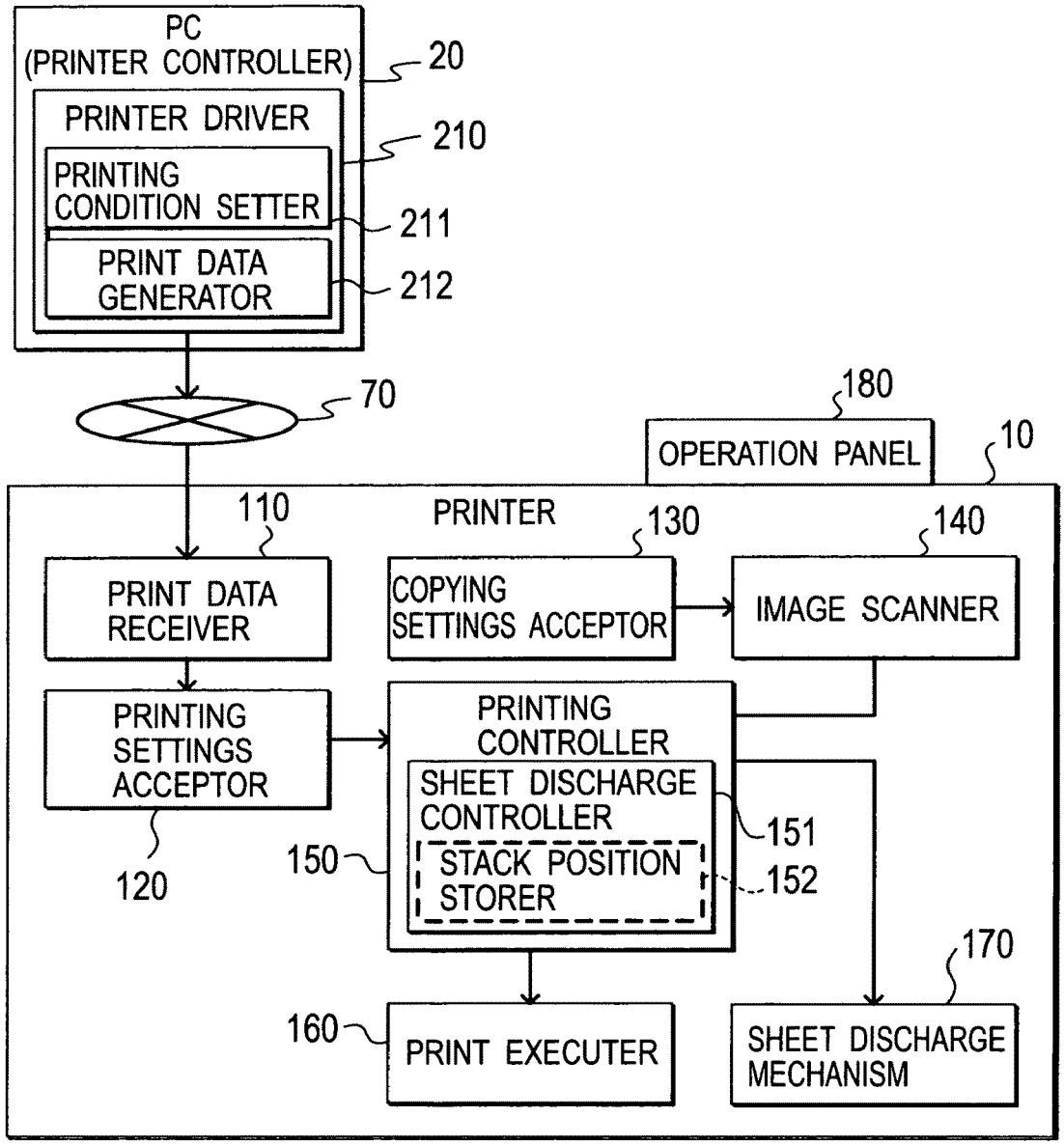
FIG. 4 is a functional block diagram of the printer and a PC (personal computer) in the networked printing system of FIG. 3.

FIG. 4 is a functional block diagram of the printer 10 and a PC 20 in the networked printing system according to the embodiment. As illustrated in the figure, the printer 10 includes a print data receiver 110, a printing settings acceptor 120, a copying settings acceptor 130, an image scanner 140, a printing controller 150, a print executor 160, a sheet discharge mechanism 170, and an operation panel 180.

The print data receiver 110 is configured to receive print data from any PC 20 through the computer network 70. The print data contains a set of data (e.g. pixel data) on a frame of image to be printed in an associated printing job, and pieces of information as data on a set of settings for the printing job.

The printing settings acceptor 120 is configured to work as a setting accepting means for accepting data on printing settings contained in a print data sent from any PC 20 or input from the operation panel 180, as necessary for the printing job. In this embodiment, for a current printing job, the data on printing settings to be accepted includes: information on presence or absence of an instruction for "a confirmation print" to print a page-sorted copy set, before a temporary pause waiting for a continuation instruction to print a total number of sheets corresponding to a designated number of copy sets; and information on presence or absence of an instruction for "a sorting print" to print the designated number of page-sorted copy sets to thereby provide the total number of printed sheets. In other words, the printing settings acceptor 120 is configured to accept a set of printing settings for the current printing job, including: a setting of a first printing condition involving the confirmation print to print a single copy set consisting of a given number of sorted pages, before a temporary pause waiting for a continuation instruction to print the total number of sheets; and a setting of a second printing condition involving the sorting print to print the designated number of copy sets each consisting of the given number of sorted pages to thereby print the total number of sheets.

The copying settings acceptor 130 is configured to work as a means for accepting settings of conditions for a printing for copying, and adapted to accept settings for the printing for copying from user, through the operation panel 180. In this embodiment, for a current printing job, the printing settings to be accepted includes: a setting of presence or absence of an instruction for "a confirmation print" to print a page-sorted copy set, before a temporary pause waiting for a continuation instruction to print a total number of sheets corresponding to a designated number of copy sets; and a setting of presence or absence of an instruction for "a sorting print" to print the designated number of page-sorted copy sets to thereby provide the total number of printed sheets.

The image scanner 140 has a light source, a lens system, a platen, an array of light receiving elements, a scanning mechanism, and the like, whereby it is adapted to scan an image of an original sheet put on the platen, convert scanned data into electric signals, and output them to the printing controller 150. The image scanner 140 may be incorporated in a housing of the printer 10, or installed alone outside the housing of printer 10.

The printing controller 150 is a functional element to implement control-related processes at the printer 10, and adapted for controls, such as frame processing and sheet feed and discharge, to be in accord with frames of print data sent from PC 20 or image data taken by the image scanner 140. The printing controller 150 may be built as a functional module using a CPU (central processing unit), memories, a frame processor, a hard disc, and the like installed in the printer 10.

The printing controller 150 includes a sheet discharge controller 151 for controlling sheet discharge and stacking actions of the sheet discharge mechanism 170, and the sheet discharge controller 151 includes a stack position storer 152 for storing in memory a last stack position in a previous printing job. The sheet discharge mechanism 170 is configured as an offset-stacking mechanism adapted for an alternating sheet discharge to a plurality of offset stack positions on a stacker, to provide defined sections of sheet stacks. The printing controller 150 cooperates with the sheet discharge controller 151 to have the stack position storer 152 store in memory a last stack position of a previous printing job. And, afterward, it receives a set of printing settings (or an adequate subset thereof) accepted for a current printing job involving an instruction for a confirmation print and an instruction for a sorting print, from the printing settings acceptor 120 or from the copying settings acceptor 140 through the image scanner 140. Further, there is a set of print data (including pixel data) input from the print data receiver 110 through the printing settings acceptor 120 or from the image scanner 140. Then, the printing controller 150 cooperating with the sheet discharge controller 151 controls the printing executer 160 to print for confirmation a copy set consisting of a given number of pages sorted in order, controlling the sheet discharge mechanism 170 to discharge the copy set for confirmation in a stack position different from the last stack position of the previous printing job. Then, it interrupts a print routine of the printing executer 160 and a discharge routine of the sheet discharge mechanism 170, to enter a temporary pause. In due course, the printing settings acceptor 120 or the copying settings acceptor 130 accepts a continuation instruction from any PC 20 or the operation panel 180. Then, the printing controller 150 cooperating with the sheet discharge controller 151 controls the printing executer 160 to print a designated number of copy sets each consisting of sorted pages, controlling the sheet discharge mechanism 170 to discharge the designated number of copy sets to one of stack positions, alternating in between every copy set, starting from the same position as the stack position of the copy set for confirmation. Among actions under control of the printing controller 150, those associated with the sheet discharge mechanism 170 are implemented through the sheet discharge controller 151. In other words, the sheet discharge controller 151 is configured to store therein a last stack position in a previous printing job, as a first stack position, and adapted, as the above-noted set of printing settings accepted has a first subset thereof including the setting of the above-noted first printing condition and the setting of the above-noted second printing condition, to discharge sheets in the confirmation print in the first subset of the set of printing settings to a second stack position offset from the first stack position, and after acceptance of the continuation instruction for the first subset of the set of printing settings, discharge sheets of the designated number of copy sets in the sorting print in the first subset of the set of printing settings to an alternating stack position alternating every copy set between the first and second stack positions, starting from the second stack position.

The print executor 160 has a printing mechanism using an image forming medium for formation of an image on a printing sheet to thereby implement a printing action. In this embodiment, it employs an inkjet printing mechanism using an ink as the image forming medium, to execute a printing by propelling ink droplets by lines from a printing head with a width covering a printing sheet. It may employ a serial type inkjet printing mechanism, or alternatively an electro-photographic printing mechanism using a toner as the image forming medium to execute a printing by deposition of toner on a sheet. Further, there may be use of a printing mechanism of any image forming apparatus else.

The sheet discharge mechanism 170 has an offset stacking function permitting a sheet discharge position to be relatively shifted to any of offset stack positions on a sheet stacking side of a stacker. In this embodiment, the stack positions are two in number, being a left and a right. The stack positions may be three or more in number, while two will be most effective in application of the invention.

The operation panel 180 is configured for, among others, control operations of the printing settings acceptor 120 and the copying settings acceptor 130 to display e.g. operation menus and contents of settings at the printer 10, for acceptance of an instruction from user through an operation menu. The operation panel 180 may be a touch-panel display, for instance.

Each PC 20 has installed therein a printer driver program developed in accordance with the printer 10, and executed by the CPU of PC 20 as necessary to form a printer driver 210. The printer driver 210 is operable for the PC 20 to function as a printing controller.

The printer driver 210 is configured for a process of producing a frame of print data such as of a document to be printed, in accordance with an instruction from user, to output to the printer 10. For this process, the printer driver 210 has a printing condition setter 211 and a print data generator 212. The printing condition setter 211 is configured to accept from user a set of settings on printing conditions such as print quality, number of copy sets, presence or absence of sorting print, presence or absence of confirmation print, sheet size, sheet type, sheet feeder designation, etc. The print data generator 212 is configured to generate a print data based on combination of a document designated as an object to be printed and a set of settings on printing conditions accepted at the printing condition setter 211, and output the print data to the printer 10.

Figure 5:
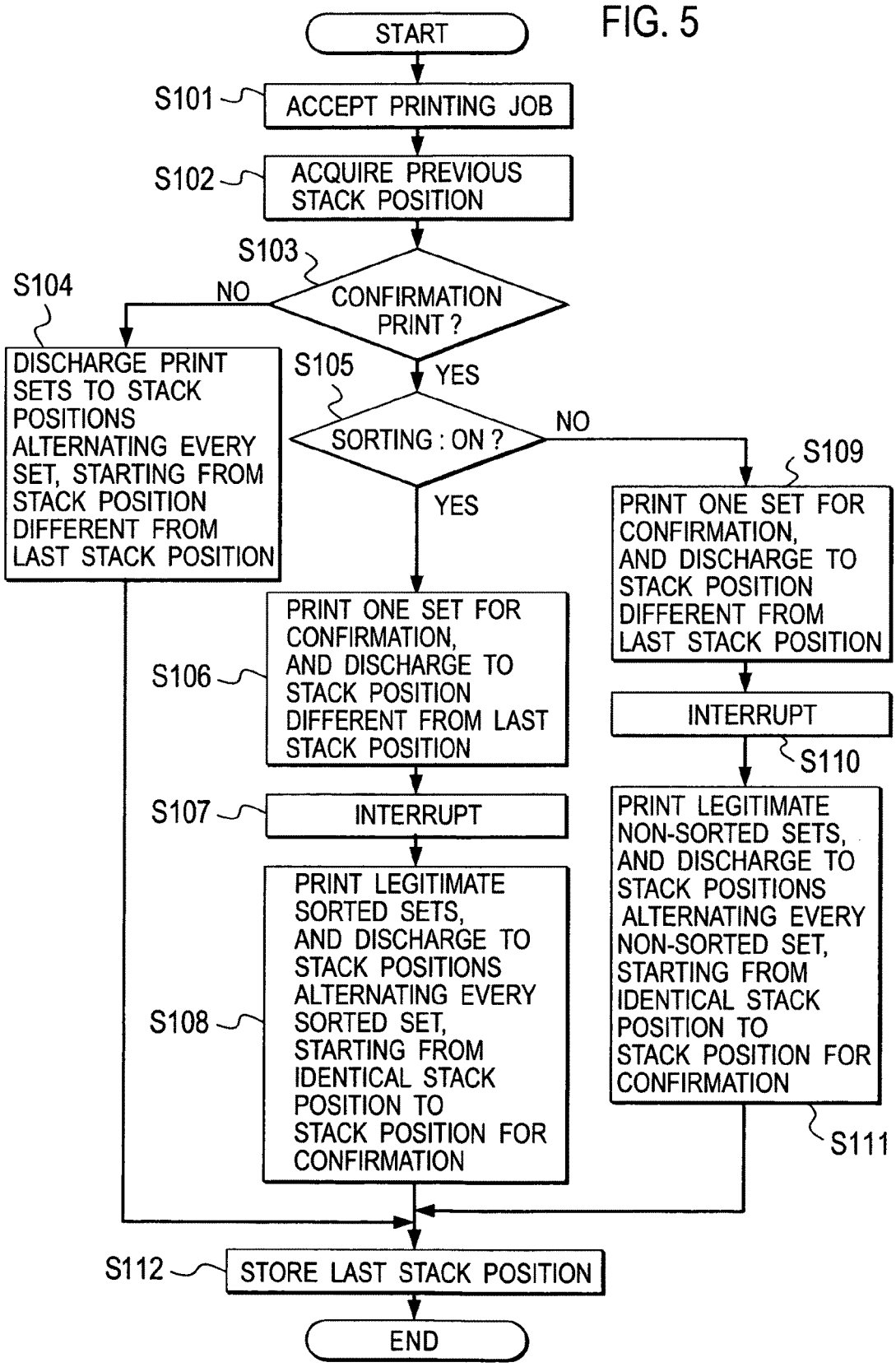
FIG. 5 is a flowchart of control actions of the networked printing system of FIG. 3.

Description is now made of control actions for sheet discharge at the printer 10 in the networked printing system, with reference to a flowchart of FIG. 5. First, at a step S101, the printer 10 accepts a current printing job. The printing job is accepted in the form of a print data received from any PC, or of an instruction received from the operation panel 180 for a copying print.

Figure 6:
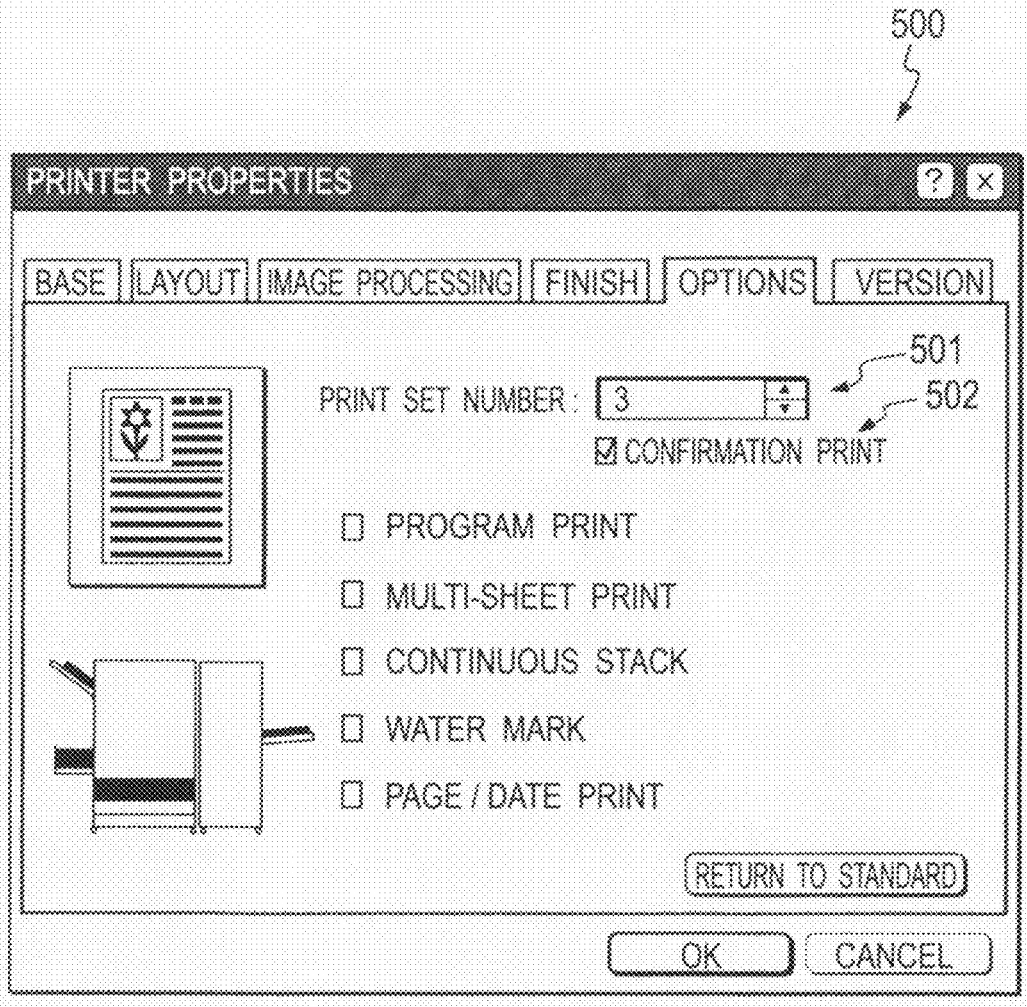
FIG. 6 is an illustration of a setting frame of the printer of FIG. 4.

For the print data transmitted from the PC 20, the user has operated the printing condition setter 211 of the printer driver 210 to provide a set of printing settings including a designation of the number of copy sets, presence or absence of confirmation print, and presence or absence of sorting print. The designation of copy set number and presence or absence of confirmation print may be set on such a print setting frame 500 as illustrated in FIG. 6, for instance. The print setting frame 500 includes a copy-set number designation field 501 and a confirmation print instruction field 502, permitting the user to designate an arbitrary copy-set number in the copy-set number designation field 501, and instruct presence or absence of confirmation print in the confirmation print instruction field 502. There is another frame (not shown) permitting an instruction of presence or absence of sorting print.

For the instruction for copying print, the user may have employed the operation panel 180 to display a copy setting frame (not shown) for designation of the number of copy sets, instruction of presence or absence of confirmation print, and instruction of presence or absence of sorting print.

After acceptance of the printing job, at a step S102, the sheet discharge controller 151 refers to the stack position storer 152, for acquisition of a final stack position in a previous printing job. This embodiment assumes a previous printing job as having been ended with a final stack position stored in the stack position storer 152.

Next, at a step S103, there is a check to a given set of printing settings, to determine whether or not an indication of confirmation print is involved. As a result, if no indication of confirmation print is involved (No at the step S103), then the control flow goes to a step S104, to discharge sheets to one of offset stack positions alternating in between every print unit, starting from a position different the last stack position in the previous printing job. For any plurality of copy sets to be printed, the print unit will be one copy set of sorted pages subject to an involved instruction for sorting print, or one copy set of non-sorted sheets of a corresponding page subject to no instruction for sorting print. This allows for defined stack sections of copy sets, as well as for defined sections of jobs.

If the indication of confirmation print is involved (Yes at the step S103), then the control flow goes to a step S105, to determine whether or not an indication of sorting print is involved. As a result, if the indication of sorting print is involved (Yes at the step S105), then the control flow goes to a step S106, first to print a single copy set for confirmation, discharging the pages to the position different from the last stack position in the previous printing job. This allows for a defined stack section of the copy set for confirmation, even if a stack set of the previous printing job is left as it is placed on the stacker.

Figure 7:
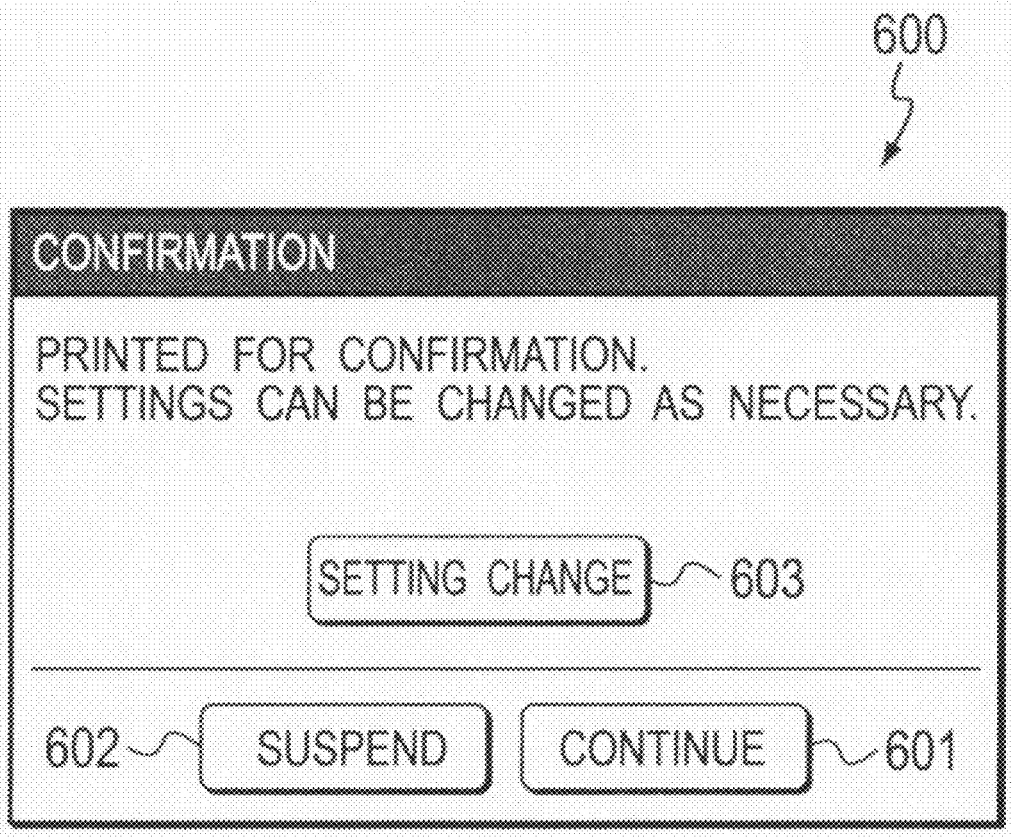
FIG. 7 is an illustration of a confirmation frame of the printer of FIG. 4.

Then, for the user's confirmation to be promoted, at a step S107, the printing is interrupted to enter a temporary pause waiting for a continuation instruction. Concurrently, the operation panel 180 displays such a confirmation frame 600 as illustrated in FIG. 7, for instance. The confirmation frame 600 indicates comments "PRINTED FOR CONFIRMATION" and "SETTINGS CAN BE CHANGED AS NECESSARY". Further, it has a continuation button 601 for accepting a continuation instruction, a suspension button 602 for suspending the printing, and a setting change button 603 for changing settings of printing conditions. It is noted that the comment "PRINTED FOR CONFIRMATION" may be replaced by an indication of "CONFIRMATION COPY EXECUTED".

After confirmation of the confirmation print, if user wants to execute a legitimate print, the user can touch the continuation button 601. For a desirable stop of the legitimate print, the suspension button 602 can be touched. Further, the setting change button 603 can be touched to change print quality, density, copy-set number, etc. If the setting change button 603 is touched, the printing settings acceptor 120 drives the operation panel to indicate a print setting acceptance frame for accepting any setting change of printing condition.

After acceptance of a continuation instruction from user, the control flow goes to a step S108, to perform a legitimate print of a number of page-sorted copy sets designated in the given set of printing conditions, discharging the pages to one of offset stack positions alternating in between every copy set, starting from the same offset position as the stack position of the confirmation print. This embodiment is thus different from the discharge control method in the past in that the discharge of legitimate print is started from the same stack position as the stack position of the confirmation print.

Figure 8A:
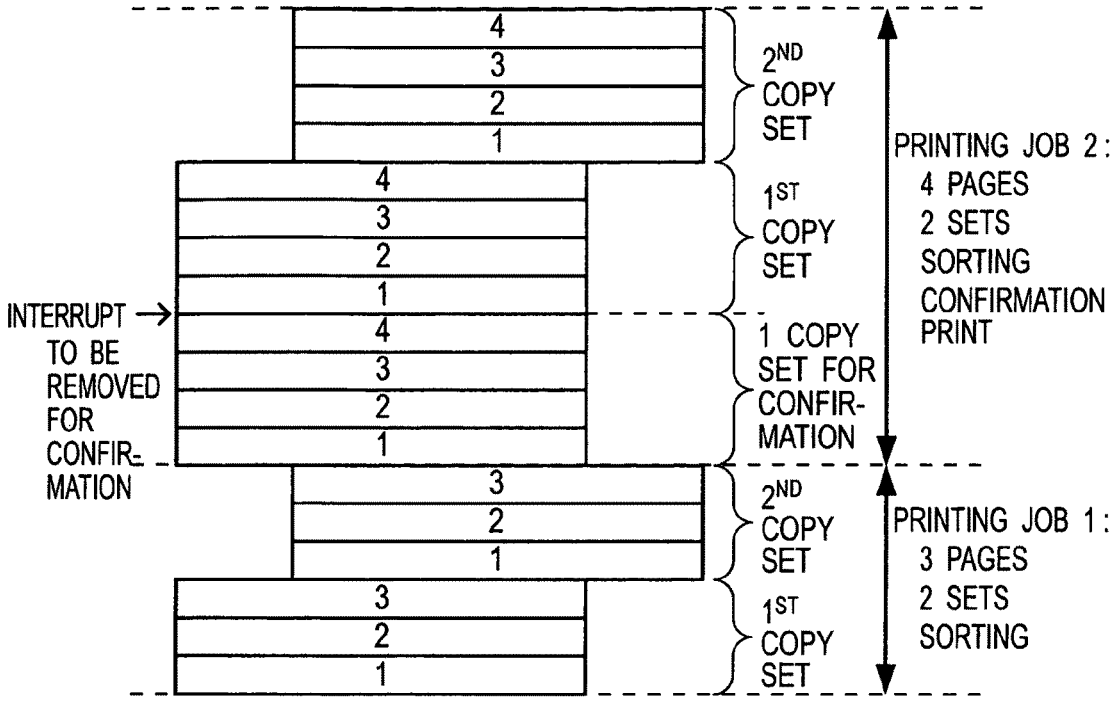
FIG. 8A is an illustration of a result of combination of a confirmation print and a sorting print of the printer of FIG. 4, and FIG. 8B, an illustration of a state after removal of a copy set printed for confirmation.

FIG. 8A illustrates a result of a sorting print subject to a setting of confirmation print. It shows a result of a printing job series including a sorting print job 1 for printing two copy sets each consisting of three pages, and a sorting print job 2 for printing two copy sets each consisting of four pages subject to a setting of confirmation print.

As illustrated in the above figure, the job 1 provides a set of copy-set stacks including a first copy set consisting of pages sorted in order and stacked in a position at the left in the figure, and a second copy set consisting of pages sorted in order and stacked in a position at the right in the figure. This allows for defined stack sections of the first and second copy sets.

The job 2 outputs, first for confirmation, a page-sorted copy set stacked in a position offset to the left from the last stack position of job 1. Then, the job 2 enters a temporary pause, where it receives a continuation instruction from user, responding thereto by outputting a combination of a page-sorted first copy set stacked in the same left position as the stack position of the copy set for confirmation, and a page-sorted second copy set stacked in a position again offset to the left. As a result, the copy set for confirmation and the first copy set look mixed, having undefined stack sections.

However, the copy set for confirmation is output in accordance with a setting by a user with an intention to check the print. Therefore, given a print for confirmation, the user will take the print out of the stacker, to check the contents before operation to provide a continuation instruction. The first copy set of job 2 is then kept from being output, permitting an easy removal of the copy set for confirmation.

Figure 8B:
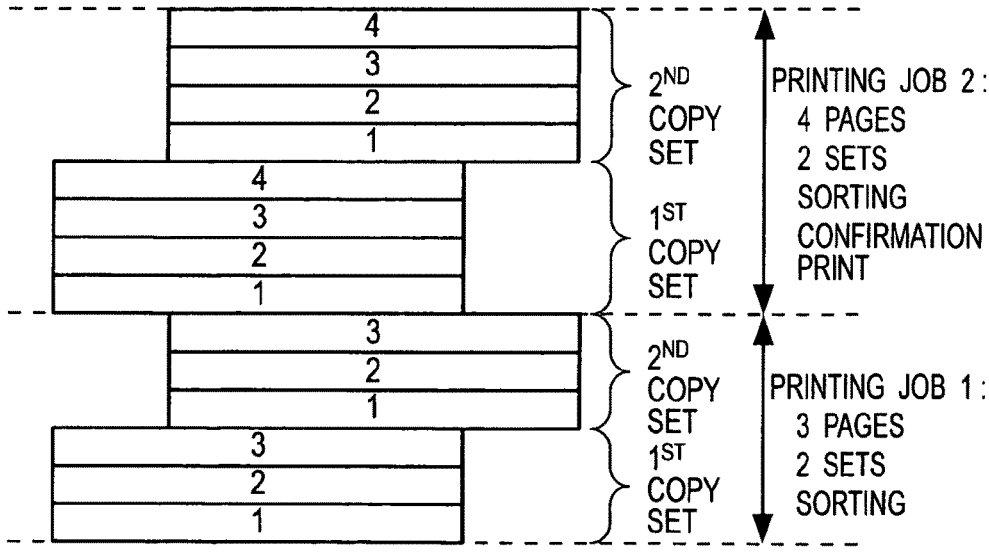

Accordingly, in practice, as illustrated in FIG. 8B, the job 2 has the first copy set discharged in a stack position offset to the left, providing the second copy set of job 1 discharged in a stack position offset to the right. As a result, the removal of copy set for conformation allows for defined stack sections of first and second copy sets, as well as for defined stack-set sections of job 1 and job 2, while permitting an effective prevention of a mixing with a result of the previous printing job left as it is without being taken out of the stacker.

Referring again to the flowchart of FIG. 5, providing that the indication of confirmation print is involved (Yes at the step S103), if no indication of sorting print is involved (No at the step S105), then the control flow goes to a step S109, to print a single copy set for confirmation, discharging the pages to the position different from the last stack position in the previous printing job. This allows for a defined stack section of the copy set for confirmation, even if a stack set of the previous printing job is left as it is placed on the stacker. It is noted that the copy set for confirmation is composed of pages sorted in order, even in combination with a non-sorting print for printing copy sets each composed of non-sorted sheets of a corresponding page.

Then, for the user's confirmation to be promoted, at a step S110, the printing is interrupted to enter a temporary pause waiting for a continuation instruction. In this case also, the operation panel 180 displays such a confirmation frame 600 as illustrated in FIG. 7. After acceptance of a continuation instruction from user, the control flow goes to a step S111, to perform a legitimate print of a number of non-sorted-sheet copy sets designated in the given set of printing conditions, discharging the sheets to one of offset stack positions alternating in between every copy set, starting from the same offset position as the stack position of the confirmation print. This embodiment is thus different from the discharge control method in the past in that the discharge of legitimate print is started from the same stack position as the stack position of the confirmation print, even in the non-sorting print. In other words, the sheet discharge controller 151 is configured to store therein the last stack position in the previous printing job, as one of the first and second stack positions, and adapted, as the set of printing settings accepted has a second subset thereof including the setting of the above-noted first printing condition, excluding the setting of the above-noted second printing condition, to discharge sheets in the confirmation print in the second subset of the set of printing settings to the other of the first and second stack positions, and after acceptance of the continuation instruction for the second subset of the set of printing settings, discharge sheets of the given number of copy sets each consisting of the designated number of sheets in the total number of sheets printed in the second subset of the set of printing settings to an alternating stack position alternating every copy set between the first and second stack positions, starting from the other of the first and second stack positions.

Figure 9A:
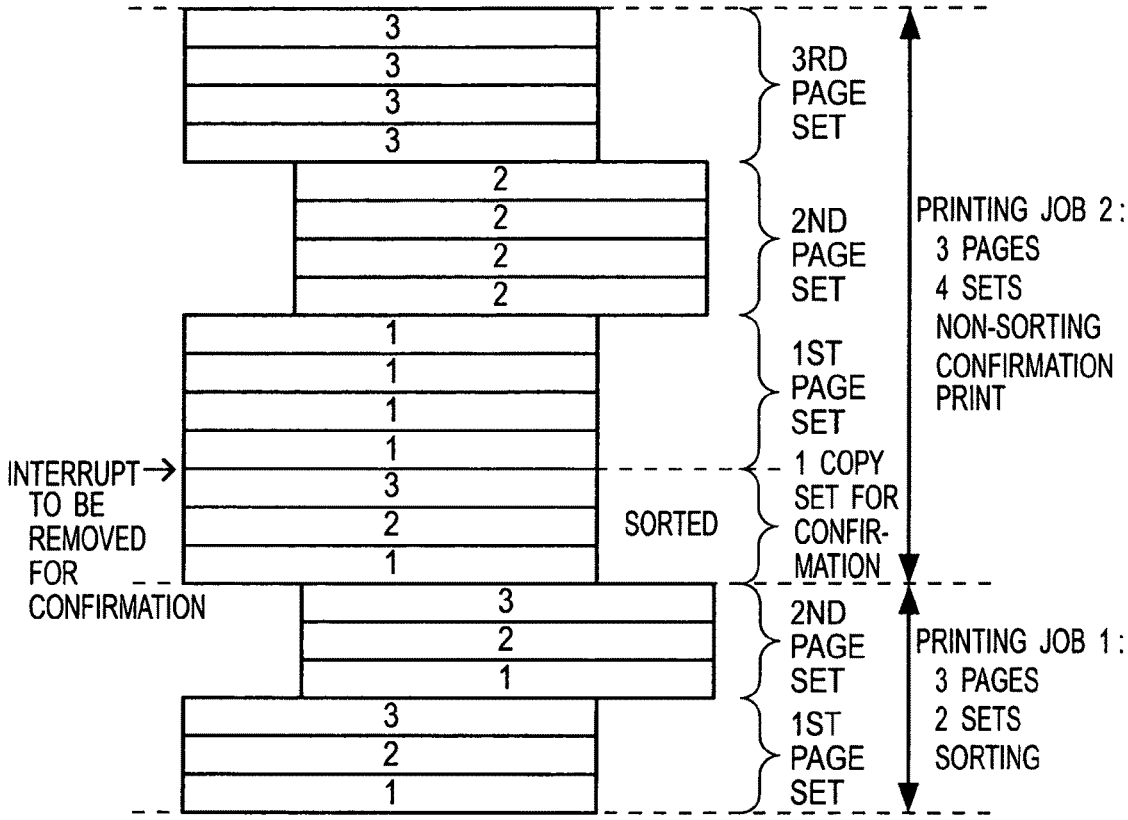
FIG. 9A is an illustration of a result of combination of a confirmation print and a non-sorting print of the printer of FIG. 4, and FIG. 9B, an illustration of a state after removal of a copy set printed for confirmation.

FIG. 9A illustrates a result of a non-sorting print subject to a setting of confirmation print. It shows a result of a printing job series including a sorting print job 1 for printing two copy sets each consisting of three pages, and a non-sorting print job 2 for printing three copy sets each consisting of four sheets of a corresponding page subject to a setting of confirmation print.

As illustrated in the above figure, the job 1 provides a set of copy-set stacks including a first copy set consisting of pages sorted in order and stacked in a position at the left in the figure, and a second copy set consisting of pages sorted in order and stacked in a position at the right in the figure. This allows for defined stack sections of the first and second copy sets.

The job 2 outputs, first for confirmation, a page-sorted copy set stacked in a position offset to the left from the last stack position of job 1. Then, the job 2 enters a temporary pause, where it receives a continuation instruction from user, responding thereto by outputting a combination of a first copy set composed of non-sorted four sheets of a first page stacked in the same left position as the stack position of the copy set for confirmation, a second copy set composed of non-sorted four sheets of a second page stacked in a position offset to the right, and a third copy set composed of non-sorted four sheets of a third page stacked in a position offset again to the left. As a result, the copy set for confirmation and the first copy set look mixed, having undefined stack sections.

However, the copy set for confirmation is output in accordance with a setting by a user with an intention to check the print. Therefore, given a print for confirmation, the user will take the print out of the stacker, to check the contents before operation to provide a continuation instruction. The first copy set of the job 2 is then kept from being output, permitting an easy removal of the copy set for confirmation.

Figure 9B:
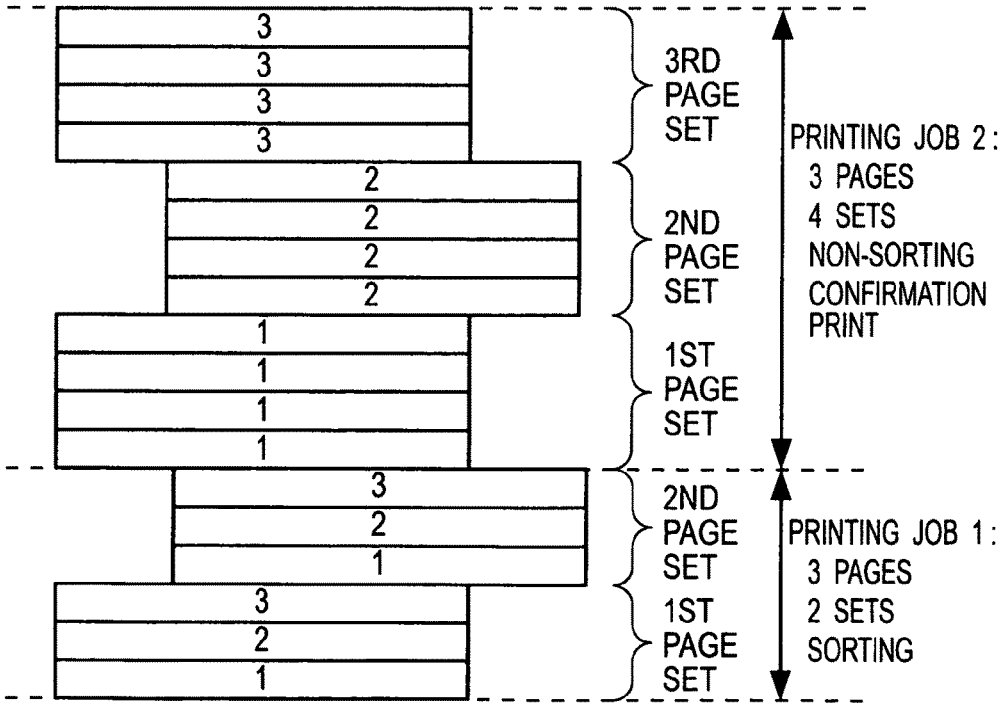

Accordingly, in practice, as illustrated in FIG. 9B, the job 2 has the first copy set discharged in a stack position offset to the left, providing the second copy set of job 1 discharged in a stack position offset to the right. As a result, the removal of copy set for conformation allows for defined stack sections of first and second copy sets, as well as for defined stack-set sections of job 1 and job 2, while permitting an effective prevention of a mixing with a result of the previous printing job left as it is without being taken out of the stacker.

(Modification)

The present invention is not restricted to the foregoing embodiment, but modifiable in a various manner. For example, it is applicable not simply to the above embodiment that has removed a copy set for confirmation before entering a subsequent printing, but also to such a case that includes printing a trial copy set to check for printing conditions such as an ink propelling condition.

For the trial copy set to be printed, the print data used may not be a legitimate one, but a stored print data of contents of some last adequate print, and may be employed to print the contents to check for printing conditions, before a legitimate print.

In the printer 10, the sheet discharge controller 151 is adapted with an accepted instruction for a trial print, to discharge sheets of the trial print to the same offset stack position as a last stack position of a previous printing job stored in the stack position storer 152. Afterward, given an instruction for sorting print, it is adapted to print a designated number of page-sorted copy sets, discharging the pages to one of offset stack positions alternating in between every copy set, starting from the same stack position as the stack position of the trial print. Like the copy set for confirmation, also the trail print might taken out from a stacker by user, so for a current printing job, the sheet stack position set to start at the same as that of the trial print would permit an effective prevention of a mixing with a result of the previous printing job left as it is without being taken out of the stacker. In other words, the printer 10 may be configured with an offset-stacking sheet discharge mechanism, a setting acceptor 120, 130, and a controller 150. The sheet discharge mechanism is adapted to discharge sheets to a plurality of stack positions. The setting acceptor 120, 130 may be configured to accept a set of printing settings including a setting of a first printing condition involving a trial print to check a printed state, and a setting of a second printing condition involving a sorting print to print a designated number of copy sets each consisting of a given number of sorted pages. The controller 150 may be configured to store therein a last stack position as a first stack position, and adapted, as the set of printing settings accepted by the setting acceptor 120, 130 has a first subset thereof including the setting of the first printing condition, to discharge sheets in the trial print in the first subset of the set of printing settings to a second stack position offset from the first stack position, and afterward as the set of printing settings accepted by the setting acceptor 120, 130 has a second subset thereof including the setting of the second printing condition, to discharge sheets of the designated number of copy sets in the sorting print in the second subset of the set of printing settings to an alternating stack position alternating every copy set between the first and second stack positions, starting from the second stack position.

Moreover, there may be a modification including a re-confirmation execution button provided for re-confirmation of a confirmation print in the confirmation frame 600 illustrated in FIG. 6. In this case, there may be a copy set discharged for re-confirmation to the same offset stack position as a stack position of a copy set for confirmation, and a number of legitimate copy sets discharged to one of offset stack positions alternating every copy set, starting from the same stack position as the stack position of the copy set for confirmation.

Further, there may be a modification including a recycle button provided in the confirmation frame 600 illustrated in FIG. 6, to handle a copy set for confirmation as part of a designated number of legitimate copy sets. This permits decrementing by unity the designated number of legitimate copy sets output after the confirmation print, allowing for a maintained provision of the designated number of copy sets.

As will be seen from the foregoing description, the present invention implements a printer including an offset-stacking sheet discharge mechanism adapted to discharge sheets to a plurality of stack positions, and a control method of the same, allowing for defined stack sections of copy sets, as well as for defined sections of stack sets of printing jobs, even after a setting of confirmation print.

While preferred embodiments of the present invention have been described using specific terms, such description is for illustrative purposes, and it is to be understood that changes and variations may be made without departing from the spirit or scope of the following claims.

The present application claims the benefit of priority under 35 U.S.C. §119 to Japanese Patent Application No. 2008-263969, filed on Oct. 10, 2008, the entire contents of which are incorporated herein by reference.

What is claimed is:

1. A printer comprising:

an offset-stacking sheet discharge mechanism adapted to discharge sheets to a plurality of stack positions;

a setting acceptor configured to accept a set of printing settings for a current printing job to print a total number of sheets corresponding to a designated number of copy sets, including a setting of a first printing condition involving a confirmation print to print a single copy set consisting of a given number of sorted pages before a temporary pause waiting for a continuation instruction to print the total number of sheets, and a setting of a second printing condition involving a sorting print to print the designated number of copy sets each consisting of the given number of sorted pages to thereby print the total number of sheets; and a controller configured to store therein a last stack position in a previous printing job, as a first stack position, and adapted, as the set of printing settings accepted by the setting acceptor has a first subset thereof including the setting of the first printing condition and the setting of the second printing condition, to discharge sheets in the confirmation print in the first subset of the set of printing settings to a second stack position offset from the first stack position, and after acceptance of the continuation instruction for the first subset of the set of printing settings, discharge sheets of the designated number of copy sets in the sorting print in the first subset of the set of printing settings to an alternating stack position alternating every copy set between the first and second stack positions, starting from the second stack position.

2. The printer according to claim 1, wherein the controller is configured to store therein the last stack position in the previous printing job, as one of the first and second stack positions, and adapted, as the set of printing settings accepted by the setting acceptor has a second subset thereof including the setting of the first printing condition, excluding the setting of the second printing condition, to discharge sheets in the confirmation print in the second subset of the set of printing settings to the other of the first and second stack positions, and after acceptance of the continuation instruction for the second subset of the set of printing settings, discharge sheets of the given number of copy sets each consisting of the designated number of sheets in the total number of sheets printed in the second subset of the set of printing settings to an alternating stack position alternating every copy set between the first and second stack positions, starting from the other of the first and second stack positions.

3. The printer according to claim 1, wherein the setting acceptor is adapted to accept a change to the set of printing settings after the temporary pause past the confirmation print.

4. The printer according to claim 1, wherein the controller is adaptive by an instruction to count the single copy set in the confirmation print as one copy set of the designated number of copy sets.

5. A printer comprising:

an offset-stacking sheet discharge mechanism adapted to discharge sheets to a plurality of stack positions;

a setting acceptor configured to accept a set of printing settings including a setting of a first printing condition involving a trial print to check a printed state, and a setting of a second printing condition involving a sorting print to print a designated number of copy sets each consisting of a given number of sorted pages; and a controller configured to store therein a last stack position as a first stack position, and adapted, as the set of printing settings accepted by the setting acceptor has a first subset thereof including the setting of the first printing condition, to discharge sheets in the trial print in the first subset of the set of printing settings to a second stack position offset from the first stack position, and afterward as the set of printing settings accepted by the setting acceptor has a second subset thereof including the setting of the second printing condition, to discharge sheets of the designated number of copy sets in the sorting print in the second subset of the set of printing settings to an alternating stack position alternating every copy set between the first and second stack positions, starting from the second stack position.

6. A control method for a printer including an offset-stacking sheet discharge mechanism adapted to discharge sheets to a plurality of stack positions, the control method comprising the steps of:

storing a last stack position in a previous printing job, as a first stack position;

accepting a set of printing settings for a current printing job to print a total number of sheets corresponding to a designated number of copy sets, including a first printing condition involving a confirmation print to print a single copy set consisting of a given number of sorted pages before a temporary pause waiting for a continuation instruction to print the total number of sheets, and a second printing condition involving a sorting print to print the designated number of copy sets each consisting of the given number of sorted pages to thereby print the total number of sheets;

discharging sheets in the confirmation print to a second stack position offset from the first stack position; and responding to acceptance of the continuation instruction, by discharging sheets of the designated number of copy sets to an alternating stack position alternating every copy set between the first and second stack positions, starting from the second stack position.

* * * * *